US005200726A

United States Patent [19]

Leppo et al.

[11] Patent Number: 5,200,726

[45] Date of Patent: Apr. 6, 1993

[54] ELECTRIC SWITCH ASSEMBLY AND RELATED METHOD OF USE

[75] Inventors: Lee E. Leppo, Tallmadge; James A. Campo, Brunswick, both of Ohio

[73] Assignee: Telxon Corporation, Akron, Ohio

[21] Appl. No.: 749,867

[22] Filed: Aug. 26, 1991

[51] Int. Cl.[5] ..... H01H 9/00

[52] U.S. Cl. ..... 335/207; 335/206

[58] Field of Search ..... 335/205-207

[56] References Cited

U.S. PATENT DOCUMENTS 3,400,347 9/1968 Macys et al. ..... 335/205

4,186,362 1/1980 Kondo et al. ..... 335/205

*Primary Examiner*—Lincoln Donovan

*Attorney, Agent, or Firm*—Pretty, Schroeder, Brueggemann & Clark

[57] ABSTRACT

An electric switch assembly for use with a magnetic reed switch includes a trigger that is movable with respect to a housing between an open position and a closed position and that includes a trigger magnet. The switch assembly further includes a second magnet, fixed relative to the housing, that is located adjacent the first magnet when the trigger is in the open position. The magnets are oriented such that their magnetic fields tend to cancel each other when the trigger is in its open position. This provides an increased disparity in the magnetic field reaching the magnetic reed switch between the open position and closed position and eliminates the need for precision alignment and individual adjustment of the magnetic reed switch at the point of manufacture.

17 Claims, 2 Drawing Sheets

ELECTRIC SWITCH ASSEMBLY AND RELATED METHOD OF USE

BACKGROUND OF THE INVENTION

This invention relates generally to electric switch assemblies and, more particularly, to electric switch assemblies having a magnetic reed switch.

Switch assemblies having magnetic reed switches are used for a variety of applications and are especially popular for use with devices that require hermetically sealed housings. A typical switch assembly in a sealed device includes a trigger with an attached magnet, which move together relative to a housing, and also includes a magnetic reed switch that remains stationary inside the housing. When the trigger is moved relatively closer to the housing into a closed position, the trigger magnet is moved closer to the reed switch and induces a magnetic field around the reed switch that is sufficiently strong to close it. When the trigger is moved away from the reed switch into an open position, the trigger magnet is moved away from the reed switch. This reduces the magnetic field around the reed switch sufficiently to open it. Thus, the difference in the magnetic field around the magnetic reed switch between the open and closed positions of the trigger is used to operate the switch.

Because the trigger magnet produces lines of magnetic force that can penetrate relatively thin materials, such as plastic, the magnetic reed switch can be placed inside the device's sealed housing and the trigger magnet still can be moved sufficiently close to the switch to open and close it. A hermetically-sealed housing provides a much better barrier against the entry of dirt and moisture around the electrical switch assembly and into the housing when compared with conventional mechanical contact switches. Moreover, magnetic reed switches have much greater reliability and normally can operate throughout the life of the device without requiring maintenance or replacement, which would necessitate opening the sealed housing. Thus, magnetic reed switches of this type are especially popular for devices where it is important to maintain hermetically-sealed housings. One such device is a laser bar code scanner.

Laser bar code scanners include a low-power laser that emits a beam and further include scanning means for directing the beam at an adjacent bar code data pattern having alternating light and dark stripes of varying width, representative of alphanumeric data. More of the beam is reflected from the light stripes than from the dark stripes and therefore the reflected beam is indicative of the bar code pattern. The scanner receives the reflected light and detects the bar code pattern, after which it quickly and accurately deciphers the reflected beam into the correct alphanumeric data. Portable laser scanners are widely used to track the level of inventory and the location of packages that are marked with bar code data, among other uses. It is very important for such scanners to be easily operable, with great reliability, under a wide variety of environmental conditions. Thus, such scanners often have a sealed housing and use a magnetic reed switch to operate the laser.

Magnetic reed switches of the kind used in laser bar code scanners must be manufactured within stringent tolerances. For example, the associated trigger is typically pivoted through a relatively small range of movement, such as an arc of only 10°, to open and close the magnetic reed switch. As a result, the reed switch must be precisely positioned within the housing relative to the trigger and the magnet so that movement of the trigger will provide sufficient disparity in the strength of the magnetic field to consistently open and close the reed switch. Even with precise reed switch placement, devices incorporating magnetic reed switches often must be individually adjusted at the point of manufacture to ensure consistent switching operation. These requirements greatly increase the cost of manufacturing such devices.

Although the electric switch assembly of the laser bar code scanner described above has proven to be generally satisfactory, it is believed that the electric switch assembly can be improved upon in several respects. For example, if the reed switch of the electrical switch assembly did not need to be precisely placed within the housing and did not need to be individually adjusted, the cost of manufacturing products requiring a hermetically sealed housing could be reduced.

It will thus be appreciated from the foregoing that there is a need for an electric switch assembly that does not require precise placement and adjustment of a reed switch during manufacturing and that will perform consistently throughout the life of the associated device. The present invention satisfies this need.

SUMMARY OF THE INVENTION

The invention provides an electric switch assembly having a trigger that is moved relative to a housing between an open position and a closed position, a first magnet that is attached to the trigger, a second magnet that is fixed relative to the housing and is located adjacent the first magnet when the trigger is in its open position, and a magnetic reed switch that is located within the housing. The electric switch assembly does not require precise placement of the reed switch and performs consistently throughout the life of the device. Thus, the switch assembly is especially suited for use with a device having a housing that is hermetically sealed.

The first and second magnets are located such that their combined magnetic field when the trigger is in its open position is reduced below what the magnetic field would be from the first magnet alone in the open position. On the other hand, the magnets are located such that their combined magnetic field when the trigger is in its closed position is substantially the same as what the magnetic field would be from the first magnet alone in the closed position. Thus, there is an increased disparity in the combined magnetic field emanating from the first and second magnets in the open and closed positions of the trigger when compared with conventional magnetic reed switches. This increased disparity makes the switch assembly less sensitive to placement of the reed switch and therefore each switch does not have to be precisely positioned and adjusted at the point of manufacture.

Both the first magnet and second magnet of the electric switch assembly preferably are elongated magnets and include a positive polarity end and a negative polarity end. The magnets are placed such that in the open position the positive polarity end of the first magnet is aligned with the negative polarity end of the second magnet, while the negative polarity end of the first magnet is aligned with the positive polarity end of the second magnet. This alignment of the magnets provides the increased disparity of the combined magnetic field between the open position and the closed position of the trigger. The invention provides an electric switch assembly with the reliability and longevity associated with magnetic reed switches but without the increased costs associated with precision reed switch placement and adjustment.

Preferably, the first and second magnets are rectangularly shaped, and the second magnet is of a smaller size than the first magnet and is fixed to the housing so that it is next to the first magnet when the trigger is in the open position. In this way, the second magnet has a magnetic field that is sufficiently strong to reduce the combined magnetic field from the first and second magnets around the reed only when the trigger is in the open position to open the reed switch, while the second magnet can close the switch when the magnet is moved closer by virtue of the trigger's movement. This allows the magnetic reed switch to be switched open and closed with a trigger motion of less than 10°.

Other features and advantages of the present invention should be apparent from the following description of the preferred embodiment, taken in conjunction with the accompanying drawings, which illustrate, by way of example, the principles of the invention.

DESCRIPTION OF THE PREFERRED EMBODIMENT

Figure 1A:
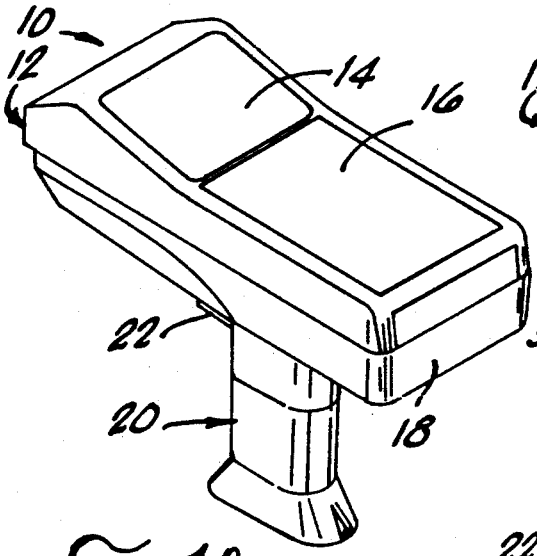
FIG. 1A is a perspective view of a laser bar code scanner having an electric switch assembly constructed in accordance with the invention.

FIG. 1A shows a laser bar code scanner 10 having a low power laser (not shown) that emits a laser beam from the scanner's front end 12 and receives back the reflected beam after it has been directed at, for example, a bar code pattern of alternating light and dark stripes. The scanner can decipher the reflected bar code data and then display it on a scanner display 14. Additional information and commands can be entered via a keypad 16. The scanner must operate under a wide variety of environmental conditions and therefore is provided with a hermetically sealed housing 18 incorporating a pistol grip 20 with an electric switch assembly 22.

Figure 1B:
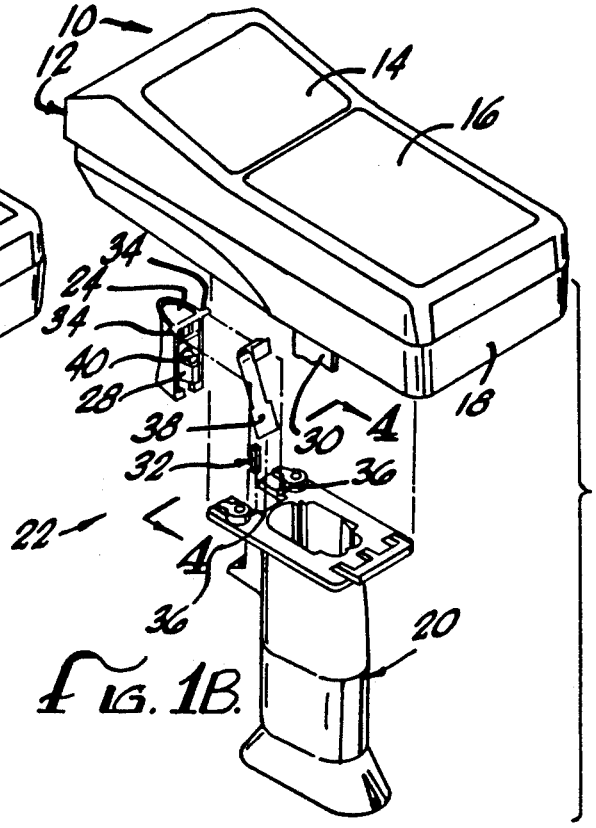
FIG. 1B is an exploded perspective view of the electric switch assembly shown in FIG. 1A.

As shown in greater detail in FIG. 1B, the electric switch assembly 22 includes a trigger 24 and an attached first magnet 28 that pivot relative to the housing 18, a magnetic reed switch 30 located within the housing, and a second magnet 32 that is fixed relative to the housing. The trigger moves between an open position (see FIG. 2) and a closed position (see FIG. 3). The first and second magnets are placed such that, in the trigger's open position, their combined magnetic fields tend to cancel each other and reduce the field around the reed switch from what it otherwise would be without the second magnet. When the trigger is moved to its closed position, the trigger and the first magnet are moved closer to the magnetic reed switch and farther from the second magnet. Moving the first magnet closer to the reed switch changes the magnetic field around the switch and closes it. These changes in the combined magnetic field around the reed switch provide an increased disparity in the magnetic field around the reed switch between the open and closed positions of the trigger that decreases the sensitivity of the assembly 22 to placement of the reed switch 30.

Figure 2:
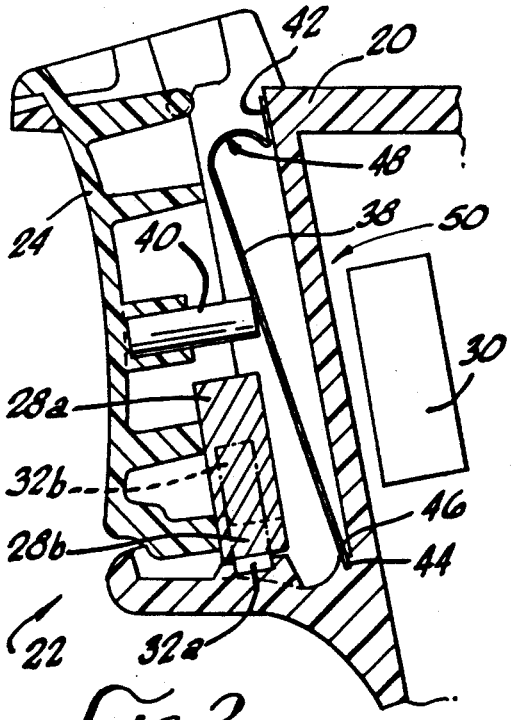
FIG. 2 is a cross-sectional view of the electric switch assembly shown in FIGS. 1A and 1B when in the open position.
Figure 3:
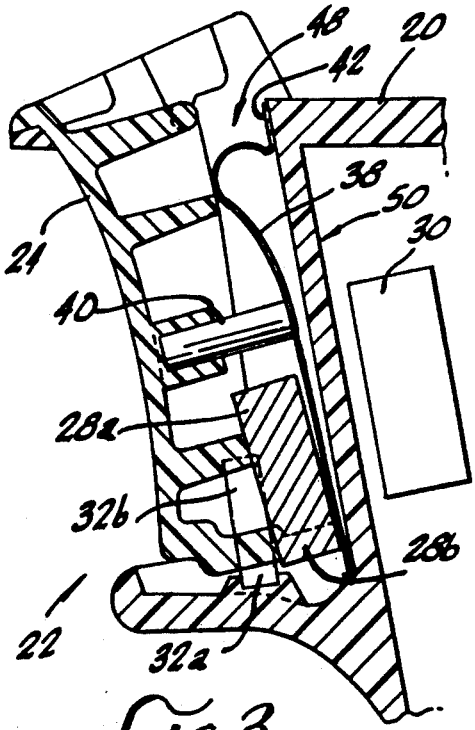
FIG. 3 is a cross-sectional view of the electric switch assembly shown in FIGS. 1A and 1B when in the closed position.

The operation of the switch assembly 22 can be best understood by comparing FIG. 2 with FIG. 3. In the open position shown in FIG. 2, the first magnet 28 and the second magnet 32 are adjacent each other, with the first magnet located at its greatest distance from the reed switch 30. With the magnets in these relative locations, the switch assembly 22 is in its open position. When the trigger 24 is depressed so as to move the first magnet 28 away from the fixed second magnet 32 and closer to the reed switch 30 as shown in FIG. 3, the switch assembly 22 is in the closed position. The first and second magnets are oriented such that, in the open position, their respective lines of magnetic force tend to cancel each other. That is, the combined magnetic field emanating from the first and second magnets in the open position is substantially reduced from the magnetic field that would emanate from the first magnet alone.

The cancellation effect is advantageously achieved by providing both magnets with a rectangular shape such that the first magnet 28 has a positive polarity end **28*a* and a negative polarity end 28*b*, while the second magnet 32 has a positive polarity end 32*a* and a negative polarity end 32*b*, and by ensuring that the ends with opposite polarity are positioned adjacent each other when the trigger 24 is in its open position. In the closed position, the first magnet 28 alone is moved away from the second magnet 32 and closer to the magnetic reed switch 30. Placing the first and second magnets such that their combined magnetic fields are reduced in the trigger's open position gives a greater disparity in the strength of the magnetic field around the reed switch between the open and closed positions. Therefore, the switch assembly is less sensitive to position of the trigger magnet 28 relative to the magnetic reed switch 30** and there is no need for precision placement of the reed switch, nor is there a need for adjustment of each reed switch at the point of manufacture.

Figure 4:
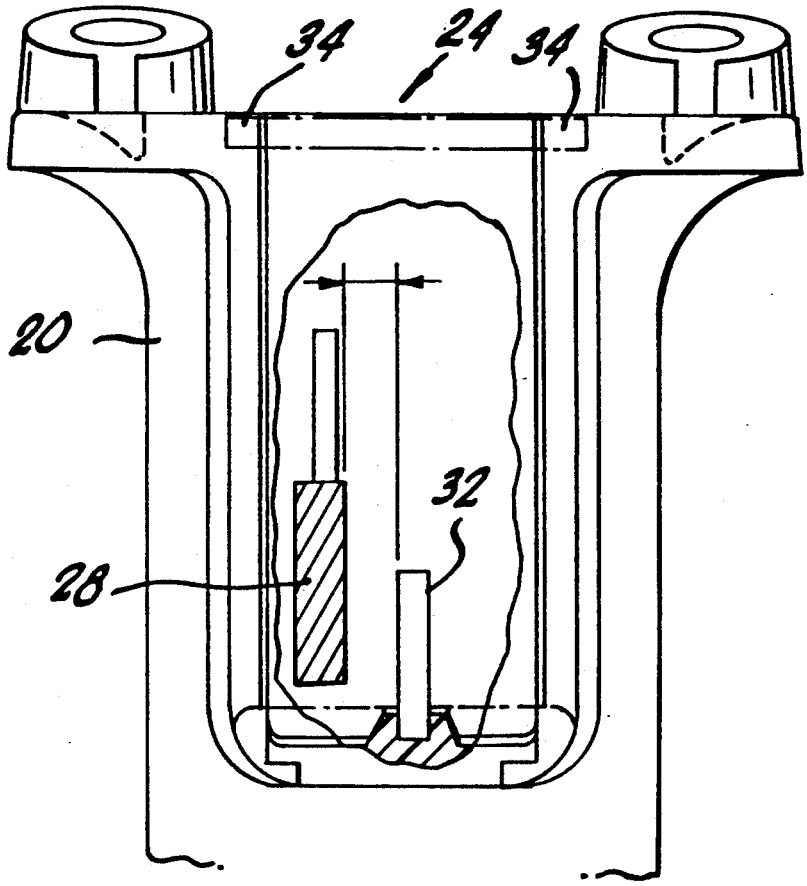
FIG. 4 is a head-on view, with partial cutaway, of the electric switch assembly shown in FIGS. 2 and 3.

To obtain the greatest disparity in the magnetic field between the open and closed positions, the first and second magnets 28 and 32 are moved as close together as possible in the open position. As the trigger 24 is moved through its range of motion, the first magnet 28 sweeps through a range of positions, or locus of motion. The second magnet 32 is placed outside of but as close as possible to the first magnet's locus of motion in the open position, as best seen in the head-on view of FIG. 4. In the preferred embodiment, the trigger pivots through an arc and, therefore, the second magnet is located adjacent the end of this arc.

The trigger 24 pivots through an arc of approximately 10°. The trigger includes pivot pins 34 that project outwardly from the sides of the trigger. The housing's pistol grip 20 includes two indentations 36 that receive the trigger's pivot pins and allow the trigger to pivot. The first magnet 28 is located in the lower end of the trigger, farthest away from the pivot pins 34. This allows the first magnet to have the maximum amount of travel between the open position and the closed position. The second magnet 32 is located adjacent to the first magnet when the second magnet is in the open position, as seen in FIG. 2.

For smooth actuation, the trigger 24 is moved against the force of a spring 38. The trigger includes a projecting post 40 that makes contact with the spring and presses against the force of the spring as the trigger is moved from the open position (FIG. 2) to the closed position (FIG. 3). Thus, applying pressure on the trigger moves it to the closed position and releasing pressure allows the spring to urge the trigger and first magnet to the open position.

The preferred embodiment includes details of construction that are designed to improve operation and reduce the cost of construction. The spring 38, for example, is simply a bent flat piece of metal that is fixed to the housing trigger 20 at a first end 42 and that is inserted into a slot 44 in the housing at a second end 46. The spring includes a curved portion 48 near the first end that provides a degree of resiliency when pressure is applied between the first and second ends of the spring. The projecting post 40 presses approximately against the spring's midpoint when the trigger 24 is moved from its open position to its closed position. Additionally, the housing 18 and its pistol grip 20 are preferably constructed from a plastic material that provides a hermetic seal and is sufficiently thin at a front end 50 adjacent the trigger 24 so as to enable the magnetic field of the first magnet 28 to close the magnetic reed switch 30 when the trigger is in its closed position. The first and second magnets 28 and 32 can be any one of several permanent magnetic materials known to those skilled in the art.

The design features of the preferred embodiment help decrease the manufacturing costs and ensure reliable operation. Fixing the second magnet 32 relative to the first magnet 28 such that their respective magnetic fields tend to cancel each other when the trigger 24 is in its open position provides an increased disparity in the strength of the magnetic field around the magnetic reed switch 30 between the open and closed positions. This greatly reduces the sensitivity of the switch assembly 22 to the position of the reed switch and eliminates both the need to precisely align the first magnet 28 through its range of motion and the need to adjust each switch at its point of manufacture. This reduces the costs of manufacturing and provides an electric switch assembly with the reliability and operational advantages of a magnetic reed switch at reduced cost.

The present invention has been described above in terms of the presently preferred embodiment so that an understanding of the present invention can be conveyed. There are, however, many configurations for electrical switch assemblies not specifically described herein, but with which the present invention is applicable. The present invention should therefore not be seen as limited to the particular embodiment described herein, but rather, it should be understood that the present invention has applicability with respect to electrical switch assemblies in a variety of applications. All modifications, variations, or equivalent arrangements that are within the scope of the attached claims should therefore be considered to be within the scope of the invention.

We claim:

1. An electric switch assembly comprising:

a housing;

a trigger attached to the housing such that it is movable between an open position and a closed position;

a first magnet attached to the trigger;

a second magnet fixed relative to the housing and located adjacent to the first magnet when the trigger is in its open position; and a magnetic reed switch located within the interior of the housing, the magnetic reed switch having a first position that it assumes when the trigger is in its closed position and having a second position that it assumes when the trigger is in its open position.

2. An electric switch assembly as defined in claim 1, wherein:

the first magnet has a positive polarity end and a negative polarity end; and the second magnet has a positive polarity end and a negative polarity end, the positive polarity end of the first magnet being aligned with the negative polarity end of the second magnet and the negative polarity end of the first magnet being aligned with the positive polarity end of the second magnet.

3. An electric switch assembly as defined in claim 1, wherein the housing is constructed of plastic.

4. An electric switch assembly as defined in claim 1, wherein the first magnet and the second magnet are rectangularly shaped.

5. An electric switch assembly as defined in claim 1, wherein the trigger is pivotally attached to the housing and the arc through which the trigger can pivot is no greater than about 10 degrees.

6. An electric switch assembly as defined in claim 1, wherein the first magnet is larger than the second magnet.

7. An electric switch assembly as defined in claim 1, wherein the second magnet is located out of the locus of motion of the first magnet.

8. A hand-held laser scanner for reading bar codes, comprising:

a hermetically-sealed housing constructed of plastic;

a trigger pivotally attached to the housing, the trigger adapted to move pivotally in an arc between an open position and a closed position, the arc of movement of the trigger being at most about 10 degrees;

a rectangular first magnet attached to, and movable with, the trigger, the first magnet having a positive polarity end and a negative polarity end;

a rectangular second magnet having a size smaller than the first magnet and having a positive polarity end and a negative polarity end, the second magnet being fixed relative to the housing and, when the trigger is in its open position, the positive polarity end of the second magnet being located adjacent to the negative polarity end of the first magnet, the negative polarity end of the second magnet being located adjacent to the positive polarity end of the first magnet, and the second magnet being located out of the locus of motion of the first magnet; and a magnetic reed switch located within the housing, the magnetic reed switch having a first position that it assumes when the trigger is in its open position and the first magnet is in alignment with the second magnet, and the magnetic reed switch having a second position that it assumes when the trigger is in its closed position and the first magnet is moved pivotally away from the second magnet and toward the magnetic reed switch, the magnetic field from the first magnet and the second magnet being substantially greater around the magnetic reed switch when the trigger is in its closed position than when the trigger is in its open position.

9. A method for switching an electric switch assembly having a housing, a trigger attached to the housing that is movable between an open position and a closed position, a first magnet attached to the trigger, and a magnetic reed switch located within the housing, comprising the steps of:

providing a second magnet that is fixed relative to the housing and located adjacent to the first magnet when the trigger is in its open position; and moving the trigger from its open position to its closed position to provide an increased magnetic field around the magnetic reed switch.

10. A method for switching an electric switch assembly as defined in claim 9, wherein the first magnet has a positive polarity end and a negative polarity end, and wherein the second magnet provided in the step of providing has a positive polarity end and a negative polarity end, and the positive polarity end of the second magnet is aligned with the negative polarity end of the first magnet and the negative polarity end of the second magnet is aligned with the positive polarity end of the first magnet when the trigger is in its open position.

11. A method for switching an electric switch assembly as defined in claim 9, wherein the first magnet and the second magnet are rectangularly shaped.

12. A method for switching an electric switch assembly as defined in claim 11, wherein the trigger is moved in the step of moving through an arc no greater than about 10 degrees.

13. A method for switching an electrical switch assembly as defined in claim 9, wherein the second magnet provided in the step of providing is smaller than the first magnet.

14. A method for switching an electrical switch assembly as defined in claim 9, wherein the second magnet provided in the step of providing is located out of the locus of motion of the first magnet.

15. A method for switching an electric switch assembly for use on hand-held laser scanners that read bar codes and that have a sealed housing, a trigger that is pivotally attached to the housing movable between an open position and a closed position in an arc of movement of at the most about 10 degrees, a rectangular first magnet that is attached to the trigger and has a positive polarity end and a negative polarity end, and a magnetic reed switch that is located within the housing, comprising the steps of:

providing a second magnet having a size smaller than the first magnet and having a positive polarity end and a negative polarity end;

fixing the second magnet relative to the housing such that, when the trigger is in its open position, the second magnet is located adjacent to the first magnet, the positive polarity end of the second magnet is aligned with the negative polarity end of the first magnet, and the negative polarity end of the second magnet is aligned with the positive polarity end of the first magnet; and moving the trigger from its open position to its closed position to provide an increased magnetic field around the magnetic reed switch, the magnetic reed switch being switched from its open position to a second position as the trigger is pivoted along its arc from its open position to its closed position, simultaneously moving the first and second magnets apart from each other.

16. An electric switch assembly for use with a device having a housing, comprising:

a trigger that is pivotally attached to the housing and is adapted to move between an open position and a closed position;

a first magnet that is fixed to the trigger and produces a magnetic field;

a second magnet that is fixed relative to the housing and produces a magnetic field; and a magnetic reed switch that is located within the housing and is switched between a first position and a second position by a predetermined change in the magnetic field around it;

wherein the second magnet is located relative to the first magnet such that the combined magnetic field around the magnetic reed switch produced by the first and second magnets together changes from when the trigger is in its open position to when the trigger is in its closed position, the change in the combined magnetic field being sufficient to switch the magnetic reed switch between its a first and a second position.

17. An electric switch assembly as defined in claim 16, wherein the second magnet is located such that, when the trigger is moved to its open position, the first magnet is moved adjacent the second magnet and the magnetic field produced by the second magnet tends to cancel the magnetic field produced by the first magnet.

* * * * *